United States Patent [19]

Klisch et al.

[11] 3,970,596

[45] July 20, 1976

[54] NON-GELLING ALPHA-OLEFIN SULFONATE LIQUID DETERGENT

[75] Inventors: Stephen Cajetan Klisch, Somerset; Charles Andrew Martin, Morris Plains, both of N.J.

[73] Assignee: Colgate-Palmolive Company, New York, N.Y.

[22] Filed: Nov. 26, 1973

[21] Appl. No.: 419,161

[52] U.S. Cl. ..... 252/546; 252/387; 252/395; 252/396; 252/548; 252/555; 252/DIG. 10; 252/DIG. 14

[51] Int. Cl.[2] ..... C11D 1/12; C11D 3/20; C11D 3/30; C11D 3/34

[58] Field of Search ..... 252/546, 555, 548, DIG. 1, 252/DIG. 10, DIG. 14, 387, 395, 396

[56] References Cited

UNITED STATES PATENTS

| | | | |
|---|---|---|---|
| 3,320,174 | 5/1967 | Rubinfeld | 252/138 |
| 3,332,880 | 7/1967 | Kessler et al. | 252/546 M |
| 3,679,611 | 7/1972 | Gerecht | 252/542 |
| 3,681,241 | 8/1972 | Rudy | 252/542 X |

FOREIGN PATENTS OR APPLICATIONS

| | | | |
|---|---|---|---|
| 247,699 | 12/1960 | Australia | 252/DIG. 15 |

*Primary Examiner*—Thomas J. Herbert, Jr.
*Attorney, Agent, or Firm*—Richard N. Miller; Murray M. Grill; Herbert S. Sylvester

[57] ABSTRACT

Liquid detergent compositions based on water-soluble alpha-olefin sulfonate detergent, preferably together with a higher alcohol ethoxylate sulfate detergent, include an anti-gelling agent, such as sodium chloride, together with a nitrate, such as sodium nitrate, the combination of which helps prevent gelation and filming of the liquid detergent on standing and also prevents corrosion of ferrous metals and ferrous alloys, such as stainless steel, which may be brought into contact with the liquid detergent compositions.

30 Claims, No Drawings

NON-GELLING ALPHA-OLEFIN SULFONATE LIQUID DETERGENT

This invention relates to liquid detergents based on water soluble alpha-olefin sulfonate detergent salts. More particularly, it is of such a liquid detergent, highly preferably also containing a higher alcohol ethoxylate sulfate detergent constituent, which includes a particular type of anti-gelling agent, preferably sodium chloride, and a nitrate, such as sodium nitrate, to help prevent gelation and filming of the liquid detergent on standing and to prevent corrosion of ferrous metal alloys, such as stainless steels, in contact with the liquid detergent.

Liquid detergents are well known products, made for both light duty and heavy duty washing applications. Among the advantages of such products are compactness, ease of packaging and handling, ease of measuring amounts to be used, rapid solubility and availability in concentrated liquid form, which is more convenient for certain applications. Almost all the production of light duty detergents for dishwashing applications is in liquid form, in which it is readily dispensed in the small quantities to be used and is easily measured, often by the capful, the small amount generally utilized for washing a sinkful of dishes and other cooking and eating utensils. It has been found that alpha-olefin sulfonate detergents, especially when combined in liquid detergent formulations with alcohol ethoxylate sulfates, make exceedingly satisfactory liquid detergent products, which clean dishes effectively and foam satisfactorily. Also, such products are more readily biodegradable than other detergents having aromatic nuclei in their molecules. However, it has been noted that liquid detergents containing alpha-olefin sulfonates tend to form films or gels, especially at liquid-gas interfaces. Such gels, films or other deposits are often visible to the consumer at the dispensing openings of containers of the alpha-olefin sulfonate-based liquid detergents. The appearances of such films or gels may inhibit dispensing through narrow dispensing container openings but even if dispensing problems are not experienced, the appearance of gel particles or films is often found to be objectionable to the consumer. Accordingly, efforts have been made to prevent gelation in such products.

The present inventors have discovered several additives which inhibit gelation and the best of these have been described in previous patent applications filed by them, such as U.S. patent applications Ser. Nos. 348,873; 349,035; and 349,111, all filed Apr. 9, 1973; and Ser. No. 350,268, filed Apr. 11, 1973, which describe the use of lower aliphatic sulfonic acids to inhibit gel formations. The disclosures of such patent applications are hereby incorporated herein by reference. In addition to the sulfonic acid gel inhibitors of those applications it has been found that isethionates, such as sodium isethionate, are also useful in preventing gelation of olefin sulfonate-based light duty liquid detergents. Various other materials have been tried as gel inhibiting additives and have been found either to be unsuccessful or to promote gelation. Thus, it was surprising that the present relatively few types of materials were found effective in inhibiting such gels and films, either by completely preventing gel and film formation initially or by noticeably diminishing development thereof over reasonable periods of open storage of the liquid detergent. Also, compartively small quantities of these relatively inexpensive compounds can be used effectively and on the whole, they are compatible with other detergent components. The effectiveness of the present materials as anti-gels is unexpected because some of them have been employed in the past as thickening agents.

In a highly preferred aspect of the invention, the anti-gelling agent utilized is of the halide type, preferably sodium chloride or lithium chloride, most preferably the former. However, it has been noted that stainless steel processing equipment contacted by the detergent product containing the halide salt may be corroded by it, leading to deterioration of the equipment and sometimes, to adverse effects on the liquid detergent due to the unintentional incorporation therein of the ferrous or other metal ions or corrosion products from the container materials. Surprisingly, it has now been discovered that nitrate, preferably sodium nitrate, counteracts the objectionable reaction and inhibits corrosion by the liquid detergent, while at the same time the nitrate content improves anti-gelling properties of the detergent liquid.

In accordance with the present invention there is provided a liquid detergent comprising a detersive proportion, in combination, of at least one water soluble olefin sulfonate salt of a carbon atom content in the range of 10 to 20 and at least one water soluble alcohol ethoxylate sulfate in which the alcohol is of a carbon atom content in the range of 10 to 20 and which contains about 1 to 20 ethoxy groups, a foam stabilizing proportion of at least one foam stabilizer, an anti-gelling proportion, in combination, of at least one halide salt and at least one nitrate salt, with the proportion of the nitrate salt being sufficient to inhibit corrosion of ferrous metals and ferrous metal alloys which are brought into contact with the liquid detergent, and an aqueous medium in which the mentioned constituents are present. In what may be considered to be a more generic invention, the liquid detergent comprises a normally gelling or film-forming proportion of at least one water soluble olefin sulfonate detergent salt and an anti-gelling and anti-filming proportion of at least one salt selected from the group consisting of halides, nitrates, sulfites, nitrites and those of aliphatic acids of 1 to 3 carbon atoms, and mixtures thereof. Also within the invention are methods of preventing gelation and filming by incorporating the mentioned anti-gelling agents in the liquid detergent formula and by adding them to the formulation after the appearance of gel or film.

The olefin-sulfonate, for its desirable detergency, will have a carbon atom content in the range of 10 to 20 per molecule, preferably from 10 to 16 and most preferably from 14 to 16. Although various water soluble olefin sulfonate salts may be employed, the alkali metal and ammonium salts are preferred and of these the most preferred are the sodium salts. The alpha-olefin sulfonates utilized may be charged to a mixer in which they are compounded with other ingredients of the liquid detergent compositions, as an aqueous liquid, normally comprising from 20 to 50% of active ingredient (the mixture of active detergent products from the sulfonation of an alpha-olefin, followed by neutralization of the product and conversion of sultones to alkenyl sulfonates). Generally, the impurities in such products will be few, usually being minor proportions, e.g., 1 to 5%, on an active ingredient basis, of sulfates and chlorides, such as the sodium salts.

A particularly suitable olefin sulfonate detergent, normally called alpha-olefin sulfonate, for use in the present liquid detergent compositions, is the sulfonation product of an olefin mixture containing about 75 to 85% of straight chain alpha-olefin, e.g., olefin of the formula $R\text{-}CH{=}CH_2$ where R is aliphatic hydrocarbon, about 8 or 10 to 20% of olefin in which the unsaturation is in a vinylidene group, e.g., olefin of the formula $$R-\underset{\underset{CH_2}{\|}}{C}-R',$$

where R and R′ are aliphatic hydrocarbon groups, preferably each having at least four carbon atoms, and about 5 to 12% of internal olefin, e.g., olefin of the formula $$R\text{-}CH{=}CH\text{-}R',$$

wherein R and R′ are aliphatic hydrocarbyl, preferably alkyl. One preferred method of preparing such an olefin mixture is by polymerization of ethylene with a Ziegler-type catalyst to produce a mixture of alpha-olefins of various chain lengths, separating therefrom a fraction containing principally $C_{12}$ to $C_{16}$ alpha-olefins, preferably $C_{14}$ to $C_{16}$, and a fraction containing lower molecular weight alpha-olefins, e.g., of 6 and 8 carbon atoms, and dimerizing the latter fraction and combining the first mentioned fraction with said dimerized fraction.

One particularly suitable olefin mixture has an average carbon atom content of about 14 to 15 per molecule, e.g., averaging 14.2 to 14.7. In a most preferred form the olefin mixture has less than 10%, e.g., below 5%, such as 2%, olefins of less than 14 carbon atoms and less than 10%, e.g., below 5%, such as 2%, olefins of more than 16 carbon atoms.

The sulfonation of the olefin may be effected with sulfur trioxide at a low partial pressure thereof, e.g., below about 100 mm. of mercury, preferably below about 25 mm. of mercury. The $SO_3$ may be in gaseous form, diluted with an inert diluent, e.g., air, or undiluted, in vacuum. It may also be in liquid form, e.g., in solution in $SO_2$ at a low temperature, such as 0°C. The $SO_3$:olefin mol ratio is usually about 1:1 to 1.2:1, preferably less than about 1.12:1, such as about 1.05-1.1:1. The reaction product from the sulfonation may be mixed with a 10 to 15% molar excess of aqueous caustic to effect neutralization of the sulfonic acids, after which it is heated to effect hydrolysis by ring opening of the sultones present in the reaction product. The resulting product typically contains, by weight, about 40 to 80%, preferably about 50 to 70% of alkenyl sulfonate, about 15 to 70%, preferably 20 to 40%, of hyroxyalkane sulfonate, about 5 to 12% of hydroxyalkane disulfonate and alkene disulfonate and up to about 7% to about 15% of impurities, which may include sodium sulfate, free oil and sodium chloride. Examples of sulfonation processes that may be used are described in U.S. Pat. Nos. 3,462,525, issued Aug. 19, 1969, to Levinsky et al.; 3,428,654, issued Feb. 18, 1969, to Rubinfeld et al.; 3,420,875, issued Jan. 7, 1969, to DiSalvo et al.; 3,506,580, issued Apr. 14, 1970, to Rubinfeld et al.; 3,579,537, issued May 18, 1971, to Rubinfeld et al.; and 3,524,864, issued Aug. 18, 1970, to Rubinfeld et al.

It is also within the broader scope of the invention to use other olefins as the raw material, e.g., olefins made by cracking petroleum wax, substantially pure alpha-olefins made by polymerization of ethylene and olefins made by dehydration of higher alcohols having average chain lengths and distributions of molecular weights described above. Also, the average carbon content may be, less preferably, outside the range of about 14 to 16 carbon atoms, e.g., 12, 13, 17 or 18 carbon atoms. Various olefin-sulfonated mixtures that may be employed to make suitable sulfonates are described in the application of Harold Eugene Wixon, entitled Viscosity Reduction of Aqueous Alpha-Olefin Sulfonate Detergent Composition, filed on the same day as the present application, the disclosure of which is incorporated herein by reference. The olefin sulfonate may be wholly or partially in the form of a water soluble salt other than the sodium salt, such as suitable ammonium, potassium, mono- di- and triethanolammonium salts or mixtures thereof.

The ethoxylated alcohol sulfate of the preferred compositions may be produced by ethylene oxide ethyoxylation of a natural alcohol or a synthetic alcohol produced by the Ziegler or Oxo processes, having from about 10 to 18 or 20 carbon atoms in the alcohol, preferably about 12 to 15, and with the alcohol preferably being a primary alkanol, sulfating the reaction product to form the monosulfate and then neutralizing to form the ammonium salt. The water soluble ethoxylate sulfates will normally contain from 10 to 20 ethoxy groups, with 1 to 10 being preferred and 1 to 5 being more preferred. Most preferably there will be 3 or about 3 ethoxy groups per molecule. Although the higher fatty alcohol lower alkoxylate sulfate is highly preferably one in which the lower alkoxy is ethoxy, it is possible to include in such detergent molecules a small proportion, e.g., 1 to 20%, preferably less than 10% by weight, of propoxy groups instead of ethoxies, providing that satisfactory water solubility and detergency are obtained in the product. Generally, when some propoxy is present the number of ethoxy groups in the molecule may be increased, e.g., by 20 to 50%, to promote water solubility. It is also within the broader scope of the invention to use other salts, e.g., alkali metal and lower alkanolammonium salts, such as sodium and triethanolammonium salts.

Typical suitable alkanols have the following distributions of carbon chains: 0.5% $C_{10}$, 33.6% $C_{12}$, 0.6% $C_{13}$, 61.1% $C_{14}$, 0.1% $C_{15}$, 3.6% $C_{16}$ and 0.4% greater than $C_{16}$; 0.7% $C_{10}$, 39.9% $C_{12}$, 2.5% $C_{13}$, 51.9% $C_{14}$, 1.4% $C_{15}$, 3.4% $C_{16}$ and 0.1% greater than $C_{16}$; 31.2% $C_{12}$, 1.8% $C_{13}$, 61.2% $C_{14}$, 1.6% $C_{15}$ and 3.6% $C_{16}$; and 0.8% $C_{11}$, 18.7% $C_{12}$, 24.2% $C_{13}$, 32.3% $C_{14}$, 20.0% $C_{15}$ and 0.3% $C_{16}$. These are considered to be essentially of 12 to 15 carbon atoms. The most preferred ethoxylate sulfates, as ammonium salts, have molecular weights of from about 420 to 460, preferably from 430 to 440, e.g., about 435.

In the liquid detergent, in additin to the alpha-olefin sulfonate active anionic synthetic organic detergent component and the highly preferred higher fatty alcohol ethoxylate sulfate, which both contribute detergency to the product, for increasing the volume of foam produced and for stabilizing it in the presence of fatty soil, as in actual dishwashing, there is utilized a foam stabilizing proportion of at least one foam stabilizer. Such materials are known in the art and often include viscosity modifying chemicals or thickening agents, such as sodium carboxymethyl cellulose, polyvinyl alcohol, polyvinyl pyrrolidone and hydroxypropyl methyl cellulose, as well as natural gums such as Irish moss, agar agar, alginates and starches, either in natural or chemically modified forms. However, the best of the foam stabilizers are the lower alkanolamides, such as those with 1 to 4 carbon atoms in the lower alkanol. Of the alkanolamides, the mono- and dialkanolamides are better and of these the ethanolamides are preferred. The higher fatty acyl moiety of the alkanolamides is normally of 10 to 20 carbon atoms, preferably of 10 to 16 carbon atoms and most preferably of 12 to 14 carbon atoms. In the most preferred embodiments of the invention the monoethanolamides are those of mixed lauric and myristic acids, with the proportions of lauric and myristic being in the range of 0.3:1 to 10:1, preferably about 3:1. Such proportions are also those utilized for dialkanolamides, such as the preferred diethanolamides. For best foam boosting and stabilizing effects a mixture of monoalkanolamide and dialkanolamide, preferably in both cases the ethanolamides, will be employed, with the proportion of monoalkanolamide to dialkanolamide being in the range of about 0.2:1 to 3:1, preferably about 0.3:1 to 1.5:1, more preferably about 0.4:1 to 1.3:1. Instead of the described alkanolamides, there may be utilized the corresponding ethoxylated alkanolamides, which usually contain 1 to 4 lower alkylene oxide groups, preferably one, and almost invariably these groups will be ethylene oxide although up to 10% propylene oxide can often be utilized.

The preferred alkanoic acid diethanolamides may be produced by reacting one mol of the alkanoic acid methyl ester with more than one mol, e.g., an excess of 5 to 10%, of diethanolamine, in the presence of heat and a basic catalyst, such as sodium methylate. The ethoxylated diethanolamides may be made by reaction of the corresponding alkanoic acid diethanolamide with ethylene oxide or other suitable oxide in the presence of a basic catalyst, such as sodium hydroxide. The monoethanolamides may be made by a similar process, utilizing the corresponding monoethanolamine as a starting material, and similarly, lower alkoxylated monoethanolamides may be prepared by alkoxylating the monoethanolamides. In all the above cases, the preferred lauric myristic substitution may be obtained by utilizing fatty acids from coconut oil, hydrogenated coconut oil, topped coconut oil or other natural products or from synthetic fatty acids. Typical suitable alkanoic acids utilized contain up to 1% of $C_{8-10}$, 71.2 ±2% of $C_{12}$, 27.8 ±2% of $C_{14}$ and up to 1% of $C_{16}$ chains.

To facilitate blending in of the monoethanolamide, such as lauric myristic monoethanolamide, it is preferably charged to the mixer for making the liquid detergent as a blend with water and hydrotrope. The hydrotrope facilitates dissolving or emulsifying of the monoethanolamide into the other materials and contributes its solubilizing effects. Preferred hydrotropes employed include alkali metal and ammonium hydrotrope salts, such as sodium xylene sulfonate, ammonium benzene sulfonate, potassium cumene sulfonate, and potassium tolyl sulfonate. The proportions of the monoalkanolamide, hydrotrope and water in the blend charged may be varied to suit the particular formulation but usually will include from 25 to 50% of the monoalkanolamide, 20 to 40% of hydrotrope and 30 to 60% of water, with a preferable formulation being in proportions of about 5 : 4 : 6, respectively. Of course, similar hydrotrope blends may be made with the dialkanolamides, if desired.

The aqueous solvent medium for the liquid detergent components is often preferably water alone. However, minor proportions of short chain alkanols of 2 or 3 carbon atoms, such as ethanol and isopropanol, and other monohydric and polyhydric alkanols or other known solvents may be present to aid in solubilizing some components of the liquid detergent. Generally, it will be desirable to limit the proportion of alcohol or such solvent present to no more than 20% of the product and preferably the alcohol content is maintained below 10%, with a proportion of less than 5% being better still. The water employed may be tap water but is preferably of a hardness less than 100 p.p.m., as $CaCO_3$, more preferably less than 50 p.p.m. hardness and most preferably, deionized water or similar zero hardness water or near zero hardness water is employed.

Due to the presence of the alpha-olefin sulfonate (and sometimes because the preferred supplementary detergent, higher alcohol ethoxylate sulfate accentuates the problem), the liquid detergent may have a film formed on the surface thereof on standing or may have bits of gel appearing therein. These are unsightly to the consumer and may block pouring orifices and therefore, are objectionable. After formation thereof in a liquid detergent they may be broken up and caused to dissolve therein by addition of particular anti-gelling and anti-filming agents to the detergent. In some cases, it may be desirable to subject a portion of the detergent to aging tests, as in open beakers, or to a laboratory gelation test known at the "racetrack test", which is described in the numbered patent applications previously referred to and incorporated herein by reference, in which test the path followed by liquid detergent running freely down a glass plate open to the atmosphere and at a 30° angle to the horizontal is noted. The shorter the path followed and the wavier the shape thereof the greater the gelling tendency of the product. Anti-gelling, anti-filming agent may be added to an aliquot of the product until it does not exhibit filming and gelling tendencies and then a proportional amount of the material may be admixed with a larger amount of the liquid detergent so as to prevent it from gelling or filming objectionably.

The anti-gelling and anti-filming additive for the present compositions is preferably sodium chloride but other alkali metal chlorides, including lithium chloride and potassium chloride, are also useful, at least in combination with sodium chloride. The lithium chloride is almost as effective as the sodium chloride, even alone, in preventing gel formation or in causing the gel or film to dissolve. Corresponding other halides, such as the bromides, fluorides and iodides, may also be employed but are not as good as the chlorides. Sodium salts capable of releasing sodium ions in the detergent medium are found to assist in preventing or limiting gelation. Although not as effective as the best halides, diminutions in gel-forming tendencies have been noted when several other materials are incorporated in these liquid detergent formulations. These include sulfites, nitrites, nitrates and lower alkanoates. Even sodium sulfate, sometimes used as a thickener, frequently helps gelproof these liquid detergents. Of the given group, the nitrates appear to be most effective when employed in combination with the halides. For example, sodium nitrate further increases the antigelling effects due to the use of sodium chloride. Of the mentioned classes of anti-gellants, preferred embodiments include sodium chloride, lithium chloride, sodium sulfite, sodium nitrite, sodium formate and sodium nitrate, especially in conjunction with sodium chloride. Such materials and other sodium ion-containing anti-gellants and anti-filmers may be employed in mixture, as may be the various detergents, foaming agents, hydrotropes, solvents and other components of the liquid detergent products. Similarly, the cations of the salts may often be interchanged so long as the final product has the same cation mixture. For example, there may be employed some ammonium alpha-olefin sulfonate together with some sodium alcohol ethoxylate sulfate when such mixture produces essentially the same final detergent product that results from employment of ammonium alcohol ethoxylated sulfate and sodium alpha-olefin sulfonate.

When a halide anti-filming agent is utilized and corrosion or possible weakenings of ferrous metals, ferrous metal alloys, such as stainless steel, e.g., 18–8, Type 316, 12% Cr or 17% Cr, or other normally corrosion resistant materials are feared, anti corrosive compounds or corrosion inhibitors may be utilized. Of these the best are the nitrates, especially the alkali metal nitrates, e.g., sodium nitrate, but other known corrosion inhibitors may be employed, too, preferably in supplementation of the nitrates, e.g., corresponding chromates, phosphates and silicates, as well as organic sulfides and amines, the latter being especially effective when the pH of the detergent is acidic or neutral. The best inhibitors, the nitrates, also exert anti-gelling effects, especially in combination with halides such as sodium chloride, and therefore the combination of sodium chloride and sodium nitrate is superior for preventing gelling and film-formation.

Although the most favored liquid detergent compositions include both the alpha-olefin sulfonate and alcohol ethoxylate sulfate, useful liquid detergents may be produced when other detergents are added to these or when a proportion of the contents of the mentioned primary detergents is replaced by another or others. Thus, the alcohol ethoxylate sulfate may be replaced partially by other anionic, nonionic or non-cationic detergents which are compatible therewith and in some cases, such detergents may be employed instead of the alcohol ethoxylate sulfates. When biodegradability is not of great importance, corresponding phenolic ethoxylate sulfates may be used, with phenol or alkyl phenol moieties replacing the fatty alcohol moieties of the preferred alcohol ethoxylate sulfate. The alpha-olefin sulfonate may be the sole detersive constituent in the liquid dishwashing detergent and when foaming power is not of critical importance to the performance characteristcs and acceptability of the detergent, the foam booster of stabilizer may be omitted.

Among the detergents which may be utilized in place of the alcohol lower alkoxylate sulfate or in supplementation of the alpha-olefin sulfonates are the anionic detergents, including higher alkyl mononuclear aromatic sulfonates, such as the higher alkyl benzene sulfonates containing from 10 to 16 carbon atoms in the higher alkyl group in a straight or branched chain, for example, the sodium, potassium and ammonium salts of various acids to result in higher alkyl benzene sulfonates, higher alkyl toluene sulfonates, higher alkyl phenol sulfonates and higher naphthalene sulfonates; paraffin sulfonates containing about 10 to 20 carbon atoms, for example, the primary paraffin sulfonates made by reacting long-chain alpha-olefins and bisulfites; and paraffin sulfonates having the sulfonated group distributed along the paraffin chain, as described in U.S. Pat. Nos. 2,503,280, 2,507,088, 3,260,741, 3,372,188 and German patent 735,096; sodium and potassium sulfates of higher alcohols containing 8 to 18 carbon atoms, such as sodium lauryl sulfate and sodium tallow alcohol sulfate; sodium and potassium salts of alpha-sulfofatty acid esters containing about 10 to 20 carbon atoms in the acyl group, for example, methyl alpha-sulfomyristate and methyl alpha-sulfotallowate; ammonium sulfates of mono- or diglycerides of higher ($C_{10}$-$C_{18}$) fatty acids, for example, stearic monoglyceride monosulfate; sodium higher alkyl glyceryl ether sulfonates; and sodium and potassium alkyl phenol polyethenoxy ether sulfates of about 1 to 6 ethoxyethylene groups per molecule and in which the alkyl radicals contain about 8 to 12 carbon atoms.

Other suitable anionic surface active agents include the $C_8$ to $C_{18}$ acyl sarcosinates, e.g., sodium lauroyl sarcoside; sodium and potassium salts of the reaction product of higher fatty acids containing 8 to 18 carbon atoms in the molecule esterified with isethionic acid; and sodium and potassium salts of the $C_8$ to $C_{18}$ acyl N-methyl taurides, for example, sodium lauroyl methyl taurate and potassium stearoyl methyl taurate.

Other types of surface active agents useful in the practice of the present invention are the nonionic synthetic organic detergents which are generally the condensation products of an organic aliphatic or alkyl aromatic hydrophobic compound and hydrophilic ethylene oxide groups. Almost any hydrophobic compound having a carboxy, hydroxy, amido, or amino group with a free hydrogen attached to the nitrogen can be condensed with ethylene oxide, its hydration product, polyethylene glycol, and sometimes with a minor proportion of propylene oxide also, to form a nonionic detergent. Further, the length of the polyethenoxy chain can be adjusted to achieve the desired balance between the hydrophobic and hydrophilic portions.

The nonionic detergents include the polyethylene oxide condensates of one mol of alkyl phenol, containing from about 6 to 12 carbon atoms in a stright- or branched-chain configuration, with about 5 to 30 mols of ethylene oxide, for example, nonyl phenol condensed with nine mols of ethylene oxide, dodecyl phenol condensed with fifteen mols of the oxide and dinonyl phenol condensed with fifteen mols of ethylene oxide. Condensation products of the corresponding alkyl thiophenols with 5 to 30 mols of ethylene oxide are also suitable.

Also included in the nonionic detergent class are the condensation products of a higher alcohol, an alkanol containing about 10 to 18 carbon atoms in a straight or branched chain configuration, preferably with about 5 to 30 mols of ethylene oxide, for example, a mol of mixed lauryl and myristyl alcohols condensed with about sixteen mols of ethylene oxide.

A very useful group of nonionics is marketed under the trade name Pluronic. Such compounds are formed by condensing ethylene oxide with a hydrophobic base formed by the condensation of propylene oxide with propylene glycol. The molecular weight of the hydrophobic portion of the molecule is of the order of 950 to 4,000 and preferably 1,200 to 2,500. The addition of polyoxyethylene radicals to the hydrophobic portion tends to increase the solubility of the molecule as a whole. The moleculer weight of these block copolymers will be from 1,500 to 15,000, and the polyethylene oxide content may comprise 20% to 80% thereof.

The polar nonionic detergents are those in which the hydrophilic group contains a semi-polar bond directly between two atoms, for example, N → O, As → O, and S → O. There is charge separation between the two directly bonded atoms, but the detergent molecule bears no net charge and does not dissociate into ions. Among the polar nonionic detergents are open-chain aliphatic amine oxides of the general formula $$R_1R_2R_3N \rightarrow O$$

For the purpose of this invention $R_1$ is an alkyl, alkenyl, or monohydroxyalkyl radical having about 10 to 18 carbon atoms, and $R_2$ and $R_3$ are each selected from the group consisting of methyl, ethyl, propyl, ethanol, and propanol radicals. A preferred example is myristyl dimethyl amine oxide. Other operable polar nonionic detergents are the open-chain aliphatic phosphine oxides having the general formula $$R_1R_2R_3P \rightarrow O$$

analogous to the amine oxides described herein. The amine and phosphine oxides may be considered to be foaming agents, stabilizers and boosters, in addition to having detersive or other surface active properties.

Zwitterionic detergents such as the betaines and sulfobetaines having the following formula are also useful:

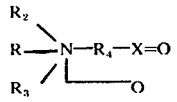

wherein R is an alkyl group containing about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine and when X is S:O the detergent is called a sulfobetaine or sultaine. Preferred betaine and sulfobetaine detergents are 1-(lauryl dimethylammonio) acetate, 1-(myristyl dimethylammonio) propane-3-sulfonate and 1-(myristyldimethylammonio)-2-hydroxypropane-3-sulfonate.

Examples of suitable ampholytic detergents include the alkyl beta-aminopropionates, $RN(H)C_2H_4COOM$ and the long-chain imidazole derivatives having the following formula:

(I)

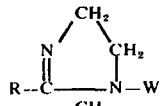

and (II)

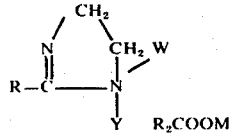

wherein R is an acyclic group of about 7 to 17 carbon atoms, W is selected from the group $R_2OH$, $R_2COOM$, and $R_2OR_2COOM$, Y is selected from the group consisting of OH and $R_3OSO_3$, $R_2$ is an alkylene or hydroxyalkylene group containing 1 to 4 carbon atoms, $R_3$ is selected from the group consisting of alkyl, alkyl aryl and fatty acyl glyceride groups having 6 to 18 carbon atoms in the alkyl and acyl groups and M is a water-soluble cation, for example, sodium, potassium, ammonium or alkylolammonium.

Formula I detergents are disclosed in Volume II of Surface Active Agents and Detergents by Schwartz, Perry and Berch, (1958), published by Interscience Publishers, and Formula II detergents are described in U.S. Pat. Nos. 2,773,068; 2,781,354; and 2,781,357. The acyclic groups may be derived from coconut oil fatty acids (a mixture of fatty acids containing 8 to 18 carbon atoms but principally lauric, myristic and palmitic acids), lauric acid, and oleic acid, and the preferred groups are $C_7$ to $C_{17}$ alkyls. Preferred detergents are sodium N-lauryl beta-aminopropionate, disodium N-lauryl iminodipropionate and the disodium salt of 2-lauryl-cycloimidium-1-hydroxyl, 1-ethoxyethanoic acid, 1-ethanoic acid.

Various adjuvants and additional components of the liquid detergents may be employed for specific purposes. Normally, the total content of such materials in the liquid detergent formulation will be less than 15% thereof, preferably less than 10% and most preferably less than about 5%. Generally, no such constituent will be present to the extent of more than 5% and preferably less than 3% of each will be utilized. Among the adjuvants may be mentioned supplementary anti-gelling agents, such as trisodium sulfosuccinate, sodium allyl sulfonate, sodium isethionate and various other useful anti-gelling inorganic sodium salts. Sequestrants may be employed, usually to clarify the detergent by sequestering hardness ions or other materials that could form insoluble flocculant precipitates or color bodies in the detergents. Among the sequestrants may be mentioned ethylene diamine tetraacetic acid, hydroxyethyl ethylene diamine triacetic acid and hydroxyethyl iminodiacetate, all as their water soluble salts, preferably as sodium, potassium or ammonium salts. Other useful sequestrants include the citrates, gluconates and other hydroxyaliphatic carboxylate salts known to have sequestering or chelating effects, preferably as sodium, potassium or ammonium salts. Water hardness chemicals may be added for soft water foaming improvement since it has been found that in the absence of hardness ions foaming is sometimes unsatisfactorily low in exceedingly soft waters. Among such chemicals that are employed the most preferred is magnesium sulfate, normally added as the heptahydrate, but instead of this compound there may be utilized calcium chloride, magnesium chloride and various other water soluble alkaline earth metal and magnesium salts. Buffers, such as salts of strong acids and weak bases or of weak acids and strong bases, may be utilized to adjust the pH of the liquid detergent and maintain it in a desired narrow range, preferably from 6.5 to 9, more preferably from 7 to 8.5 and most preferably from 7.2 to 8, at which pH's gelling, film forming and corrosion are less with the present compositions. To keep the pH's in such ranges the buffers employed will normally be of a strong base, such as sodium hydroxide, and a weak acid, e.g., acetic acid, citric acid or gluconic acid. Thus, the citrates and gluconates may perform both buffering and sequestering functions.

Among other adjuvants that are normally utilized are included proteinaceous materials, useful for conditioning of the hands, among which materials are mentioned water soluble proteins such as hydrolyzed collagens of such low molecular weights as to be completely soluble in water, non-gelling and non-denaturing. Suitable such products have an average molecular weight of about 500 to 10,000, preferably about 1,000. Also, useful are emollients, solubilizing agents, bactericides, fungicides, antioxidants, stabilizers, enzymes, perfumes, coloring agents, including soluble dyes and water dispersible pigments, emulsifiers, fluorescent brighteners, lanolin derivatives and other skin conditioning fats and oils. For heavy duty detergent compositions there will be utilized builder salts such as silicates, carbonates, phosphates (including tripolyphosphates and pyrophosphates), bicarbonates and borates, preferably as the alkali metal or ammonium salts, e.g., sodium, potassium and ammonium salts of the above types, including tetrapotassium pyrophosphate, pentasodium tripolyphosphate, sodium silicates of an $Na_2O:SiO_2$ ratio in the range of 1:1.6 to 1:2.8, especially 1:2.0 to 1:2.6, and ammonium phosphate. However, for the preferred light duty dishwashing liquids of the present invention builder salts will normally be too harsh on the hands (and usually they are used in larger quantities than ordinary adjuvants, e.g., 5 to 20%) and none will be employed.

The various components of the liquid detergents mentioned above are available commercially. The alpha-olefin sulfonates may be made by a Stepan Chemical Company, Chemithon Corporation, Allied Chemical Corporation or a liquid process for sulfonating Ziegler, cracked wax, modified Ziegler or Ziegler - dimer alpha-olefins or alpha-olefin blends, which are available from Ethyl Corporation, Chevron Chemical Company, Inc., Gulf Oil Company, Shell Chemical Company and Jefferson Chemical Company. The ethoxylated alcohol sulfates are available as Alfonic 1412-A and Neodol 24-3A. The monoethanolamides are sold as Monamid LM-MA and Emid No. 6504 grade and the diethanolamides are sold under the names Trepoline STD and Monamide 150 LMW-C. Commercial ethoxylated alkanoic acid monoethanolamides are on the market under the names Amidox L-1 and Amidox C-1. Various other detergents and foaming agents are also sold under related names, known to those in the art.

The proportions of the various components of the present liquid detergents that are employed are such as to make a product having good detergency and foaming abilities, with no gelation or film forming and with a minimization of corrosion of ferrous metal alloys, such as stainless steels. Thus, when utilizing the preferred formula in which the active detergent ingredient is a mixture of at least one water soluble olefin sulfonate salt of 10 to 20 carbon atoms and at least one water soluble alcohol ethoxylate sulfate of an alcohol carbon atom content of 10 to 20 and of 1 to 20 ethoxy groups, with at least one foam stabilizer, at least one halide salt and at least one nitrate salt, the proportions of the various components will be sufficient to make the liquid satisfactorily detersive, with stable foam, non-gelling and non-film-forming and non-corrosive to stainless steel. To accomplish this there will normally be utilized from 6 to 22% of water soluble olefin sulfonate salt, preferably 12 to 22% thereof and most preferably, from 15 to 20 %; 10 to 20% of alcohol ethoxylate sulfate, when present, preferably 12 to 18% thereof; 2 to 7% of fatty acid alkanolamide, preferably 3 to 6% thereof; 0.2 to 8% or 2 to 8% of alkali metal halide or suitable anti-gelling agent, preferably 2 to 6% thereof and most preferably about 2 to 4%; and 1 to 15% of nitrate, preferably 1 to 5% and most preferably 1 to 4% thereof. The water contents will range from 24 to 73% to 45 to 67% and more narrowly, to 48 to 67%. In a particular preferred formula there will be present about 18% of the alpha-olefin sulfonate, about 15% of the alcohol ethoxylate sulfate, about 2.4% of lauric myristic monoethanolamide, about 2% of lauric myristic diethanolamide, about 2.6% of sodium chloride, about 2% of sodium nitrate and about 58% of water, whereas in another preferred formula the proportions will be respectively, about 16.1%, 13.8%, 1.5%, 3.5%, 2.5%, 2% and 58%, with additionally, 1.8% of hydrotrope, 0.5% of water hardness chemical and 0.1% of sequestrant in both formulas.

When the liquid detergent contains no alcohol ethoxylate sulfate (AEOS) the proportions of the other constituents may be essentially the same, with that of the aqueous medium being increased to compensate for the absence of the AEOS. Similarly, when the AEOS is replaced by another suitable detergent, the proportion of such detergent may be that previously designated for the AEOS content. Of course, in the absence of AEOS or such other detergent the range of percentages of aqueous medium which is preferably water, with only the smallest proportion of alcohol needed to solubilize all components, will be modified, usually being from 49 to 69% and given are from 50 to 68%. The percentages givenare for pure compounds or for mixtures of compounds in all cases except where a single specific compound is mentioned. When the alpha-olefin sulfonate content is reduced, to about 5 to 11%, preferably 6 to 10%, e.g., 8%, the AEOS is omitted but an alkoxylated fatty alcohol nonionic detergent is present instead, such as 2 to 8%, preferably 3 to 6%, e.g., 4% of an essentially $C_{10}$ alcohol ethoxylate of 55 to 60% EtO content, the alkanolamide content is 2 to 7%, preferably 3 to 7%, e.g., 4%, and preferably it is all dialkanolamide, e.g., LMDEA, the presence of larger proportions of anti-gelling agent is not required and from 0.2 to 1%, preferably 0.5 to 0.9%, e.g., 0.8% of NaCl, will give a good product, which doesn't film, gel or corrode stainless steel.

For the preferred liquid detergent formulations a weight ratio of olefin sulfonate to alcohol ethoxylate sulfate will usually be from 0.4:1 to 3:1, preferably 0.5:1 to 2:1 and such preferable proportions also apply to mixtures of the alpha-olefin sulfonate and other detergents used in replacement of AEOS. The ratio of nitrate to halide will be in the range of 0.5 to 3, preferably from 0.7 to 1.5. Part of the halide may be replaced with other anti-gelling agents, in which case the nitrate:halide ratios will usually remain the same or may be increased from 10 to 50% if the replacing anti-gellant is corrosive to the stainless steel or other material of processing equipment utilized.

The manufacture of the present detergents is relatively simple. The alpha-olefin sulfonate, water and solvent, if utilized, are combined and are mixed with low speed agitation at room temperature. To the mixture are then added in order the formula amounts of lauric myristic diethanolamide (LMDEA), lauric myristic monoethanolamide (LMMEA), sodium xylene sulfonate (SXS) and accompanying water (LMMEA, SXS and water may be present in a pre-mix), magnesium sulfate, if used, sequestrant, if employed, and ethoxylated alcohol ammonium sulfate or replacement. The ingredients are mixed for about 2 to 10 minutes, preferably about 5 minutes, or until the mixture is uniform. The pH is then adjusted to the desired range by the addition of acid or alkali, e.g., HCl and NaOH, as necessary, and various adjuvants, such as hand care preparations, coloring agents and perfume are then added, if desired. The mixture may be filtered to produce a clear product and may be sent to storage for future use. An aliquot is tested to determine the proportion of anti-gelling agent needed to prevent film formation and gel production in use. Then, the required amount of anti-gellant is admixed with the stored formula, together with the anti-corrosion agent, and the formula may then be bottled. In the future, of course, the determined desired proportions of anti-gel and corrosion inhibitor may be added during formulation, preferably with the magnesium sulfate heptahydrate or other powdered components. In those cases where material being stored shows gel or film formation the gel or film will be redissolved upon addition of the desired proportion of anti-gellant. Of course, the proportion of anti-gellant utilized will be within the ranges previously given, taking into account the anti-gellant present with any of the materials charged to the mixer. For example, a small percentage of sodium chloride, e.g., 0.1 to about 1%, usually 0.2 to 0.6% is often present with the alpha-olefin sulfonate detergent and must be allowed for in computing the proportion of anti-gellant to be added to prevent gelation. The various mixing operations may take place at room temperature when the mixture of monoalkanolamide, hydrotrope and water is employed but if the alkanolamide is used alone it may be desirable to heat the detergent mix to solubilize all components readily. Such heating may be to temperatures as high as 40° to 50°C. but normally it is preferred to mix components at room temperature, e.g., 18°–25°C.

The products made, which may consist essentially of only the alpha-olefin sulfonate detergent and anti-gelling agent, with the supplemental AEOS detergents, alkanolamide(s) and anti-corrosion agent(s) being highly preferred but optional additives, are very satisfactory liquid detergents, foaming well and being effective for cleaning dishes. They do not objectionally gel or form films, due to their contents of the discovered effective anti-gelling agents, and may be dispensed from squeeze bottles having restricted dispensing openings, without any gels or films causing blockings of those passageways.

The invention of the present compositions and the methods for preventing and dissolving formations of films and gels therein is considered to apply broadly to light duty liquid detergents containing alpha-olefin sulfonates in detersive quantities, including various proportions thereof. It is especially applicable to those preferred compositions, previously described, which contain the supplemental AEOS detergent and nitrate anti-corrosion agent (when halide or other corroding anti-gellant is used in a corroding quantity). The improvement in gel inhibition is a very significant one and often allows the formulation of liquid detergents containing no auxiliary solvents, such as alcohols, which are drying to the skin and comparatively expensive and therefore are desirably omitted from liquid detergent formulas.

The following examples are given to illustrate but not limit the invention. Unless otherwise mentioned, all parts are by weight and all temperatures are in °C.

EXAMPLE 1

Light duty detergents suitable for dishwashing applications, are made in accordance with the following formulas by the methods previously described and by other methods in which the constituents are mixed in different orders to produce clear products. In a preferred manufacturing method the alpha-olefin sulfonate detergent is dissolved in a major proportion of the water and the lauric myristic diethanolamide is admixed with the aqueous solution, after which a mixture of lauric myristic monoethanolamide, sodium xylene sulfonate and water is added to it, followed by further additions of the sequestrant, anti-gellant, anti-corrosion compound, water hardness additive and alcohol ethoxylate sulfate detergent, followed by additions of the color solution and perfume, all the mixings being effected at room temperature, about 20°C.

| | Percent |
|---|---|
| * Sodium alpha-olefin sulfonate (+0.3% NaCl) | 16.1 |
| ** Ammonium higher fatty alcohol ethoxylate sulfate | 13.8 |
| Lauric myristic diethanolamide (L:M = 3:1) | 3.0 |
| Lauric myristic monoethanolamide (L:M = 3:1) | 1.5 |
| Sodium xylene sulfonate | 1.2 |
| Water (accompanying LMMEA and SXS) | 1.8 |
| $MgSO_4.7H_2O$ | 1.0 |
| Trisodium hydroxyethyl ethylene diamine triacetate | 0.1 |
| Aqueous dye solution (over 99% water) | 0.1 |
| Perfume | 0.4 |
| Sodium chloride | X |
| Sodium nitrate | Y |
| Ethanol | 7.0 |
| Deionized water | q.s. |
| | 100.0 |

*Sulfonation product of a $C_{14-16}$ alpha-olefin mitute averaging about $C_{14.5}$ and containing about 60% alkenyl sulfonate, 30% of hydroxyalkane sulfonate and about 10% of a mixture of hydroxyalkane disulfonate and alkene disulfonate.

**Of a higher fatty alcohol of 12 to 15 carbon atoms per molecule, with 3 EtO's in each molecule.

The amounts of sodium chloride and sodium nitrate employed are varied from 0 to 6% of the final composition, with mixtures thereof also being utilized. From 0.1 to 0.6% on top of the formula amounts of NaCl accompany the olefin sulfonate, which may also include 0.1 to 1.5% $Na_2SO_4$, preferably 0.3 to 1% thereof (product basis). The liquid detergents made are tested for dishwashing ability, both with respect to detergency and foaming, by mini-plate and practical dishwashing testing, and are found to be very satisfactory, effectively cleaning dishes and possessing long lasting foams during use. However, because control products containing no sodium chloride and no sodium nitrate tend to form films or gels, the products are tested for such properties, utilizing beaker and "racetrack" tests.

In the beaker tests the described liquids are poured into laboratory beakers, e.g., of 250 ml. capacity, and changes in the character of the liquid surfaces as the beakers stand exposed to air are noted. Various volumes of liquid may be utilized in beakers of various sizes and the results are essentially the same as when about 200 ml. of liquid detergent is stored open to the air in a 250 ml. beaker. The changes in liquid surfaces are characterized and are given numerical ratings according to the following scheme:

| | |
|---|---|
| 0 | no change |
| 1 | slight film |
| 2 | film |
| 3 | very slight skin |
| 4 | slight skin |
| 5 | skin |
| 6 | soft gel, pourable |
| 7 | gel, pourable |
| 8 | thick skin |
| 9 | thick skin, not pourable |
| 10 | gel, not pourable |

The following table lists the evaluations for a variety of formulas after periods of time ranging from 15 minutes to one day, and the totals of the numbers listed, given in the last column, are taken as indicative of the tendencies to gel of the products, with the highest numbers being obtained for the products that gel most.

TABLE I

| % NaCl (X) | % $NaNO_3$ (Y) | Gelling Score (after noted hours) 1/4 | 1/2 | 1 | 2 | 3 | 4 | 5 | 6 | 24 | Total |
|---|---|---|---|---|---|---|---|---|---|---|---|
| 0 | 0 | 4 | 5 | 5 | 8 | 9 | 9 | 9 | 9 | 9 | 67 |
| 2.0 | 1.5 | 1 | 2 | 3 | 4 | 4 | 4 | 4 | 4 | 5 | 31 |
| 2.0 | 2.0 | 0 | 1 | 2 | 4 | 4 | 4 | 4 | 4 | 4 | 27 |
| 2.0 | 2.5 | 0 | 1 | 2 | 2 | 3 | 3 | 3 | 3 | 3 | 20 |
| 2.5 | 2.0 | 0 | 0 | 0 | 0 | 0 | 0 | 0 | 0 | 1 | 1 |
| 2.5 | 2.5 | 0 | 0 | 0 | 0 | 0 | 0 | 0 | 0 | 1 | 1 |
| 2.5 | 3.0 | 0 | 0 | 0 | 0 | 0 | 0 | 0 | 0 | 1 | 1 |
| 3.0 | 2.5 | 0 | 0 | 0 | 0 | 0 | 0 | 0 | 0 | 1 | 1 |
| 3.0 | 3.0 | 0 | 0 | 0 | 0 | 0 | 0 | 0 | 0 | 1 | 1 |
| 3.0 | 3.5 | 0 | 0 | 0 | 0 | 0 | 0 | 0 | 0 | 1 | 1 |
| 2.0 | — | 3 | 4 | 5 | 5 | 5 | 5 | 5 | 5 | 8 | 45 |
| 3.0 | — | 0 | 0 | 2 | 3 | 4 | 4 | 4 | 4 | 2 | 23 |
| 4.0 | — | 0 | 0 | 0 | 0 | 0 | 0 | 0 | 0 | 1 | 1 |
| 5.0 | — | 0 | 0 | 0 | 0 | 0 | 0 | 0 | 0 | 1 | 1 |
| 6.0 | — | 0 | 0 | 0 | 0 | 0 | 1 | 1 | 1 | 1 | 4 |
| — | 2.0 | 4 | 5 | 5 | 5 | 8 | 8 | 8 | 8 | 9 | 60 |
| — | 3.0 | 4 | 4 | 5 | 5 | 8 | 8 | 8 | 8 | 9 | 59 |
| — | 4.0 | 4 | 4 | 4 | 5 | 5 | 8 | 8 | 8 | 9 | 55 |
| — | 5.0 | 3 | 3 | 3 | 4 | 4 | 5 | 5 | 5 | 8 | 40 |
| — | 6.0 | 2 | 2 | 3 | 3 | 4 | 4 | 5 | 5 | 4 | 32 |

From the table it is seen that with neither sodium chloride nor sodium nitrate anti-gellants present or with only sodium nitrate or comparatively small amounts of sodium chloride present, gelling is more pronounced than when mixtures of sodium chloride and sodium nitrate are utilized. Especially useful are those mixtures containing about 2.5 to 3% of sodium chloride with 2 to 3 or 3.5% of sodium nitrate, although significant decreases in gelling tendencies are obtained when the proportions are also within the 2 to 4% and 1 to 4% ranges, respectively. Because of the tendency of sodium chloride to cause corrosion of stainless steel tanks, lines, pumps and mixing equipment at concentrations above 2% and sometimes even at concentrations of as low as 1 or about 1.5%, it is desirable to maintain the sodium chloride content as low as feasible and to utilize sufficient sodium nitrate to overcome the corroding action of the sodium chloride while at the same time, improving anti-gelling effects. The halide content will usually be held to 8% maximum. When the "racetrack" test of gelling tendencies of liquid detergent compositions is employed, instead of the beaker test, similar results are obtained. A description of that test is found earlier in this specification.

When the alcohol ethoxylate sulfate is removed from the formula and its place taken by deionized water, similar testing yields essentially the same types and orders of results, with good anti-gelling activities being apparent at about the same concentrations of anti-gelling agent as in the above table. Such results also obtain when all the other components except the alpha-olefin sulfonate are removed. Similarly, when the concentrations of this material are altered, in both the given formula and the modified formulas described, non-gelling and non-film-forming liquid detergents of satisfactory dishwashing characteristics are obtained. Thus, the proportion of alcohol ethoxylate sulfate may be varied from about 12 to 22% but is preferably held in the 15 to 20% range and acceptable products result. This is also the case when the alpha-olefin sulfonate is of alpha-olefins in the 10 to 20 carbon atom content range, preferably 10 to 16 carbon atoms, e.g., 10, 12, 14 and 16 carbon atoms and mixtures of 10 and 12, 12 and 14 and 12 to 16 carbon atoms. Furthermore, when any of the above compounds is utilized as the sodium or potassium salt, instead of the ammonium salt, by treatment according to the methods and in the proportions described in this example and the above table, non-corrosive (or corrosive) non-gelling products are made, depending on salt and nitrate contents. One may use ammonium alpha-olefin sulfonate when alkali metal AEOS is substituted for its corresponding ammonium salt. Changes in the cations of the halide and nitrate components, at least with respect to only a part of the entire contents of such components, do not prevent the anti-gelation and anti-corrosive activities thereof. Neither does the incorporation of various other adjuvants, such as hydrolyzed proteins, bactericides, opacifying agents, supplementary detergents, ethoxylated alkanolamides and supplementary solvents, e.g., ethanol, isopropanol.

| | | Percent |
|---|---|---|
| * | Sodium alpha-olefin sulfonate (with 0.3% NaCl) | 16.1 |
| ** | Ammonium higher fatty alcohol ethoxylate sulfate | 13.8 |
| | Lauric myristic diethanolamide | 3.0 |
| | Lauric myristic monoethanolamide | 1.5 |
| | Sodium xylene sulfonate | 1.2 |
| | Water (accompanying LMMEA and SXS) | 1.8 |
| | $MgSO_4.7H_2O$ | 1.0 |
| | Trisodium hydroxyethyl ethylene diamine triacetate | 0.2 |
| | Aqueous dye solution (over 99% water) | 0.1 |
| | Perfume | 0.4 |
| | Ethanol | 7.2 |
| | Anti-gellant | Z |
| | Deionized water | q.s. |
| | | 100.0 |

EXAMPLE 2

Liquid detergents of the above formula are made according to the method described in Example 1, utilizing various percentages (Z) of anti-gellants and running a control experiment with no anti-gellant. The products made are tested in the manner described in Example 1 and each anti-gellant formula is given a numerical rating of effectiveness in preventing filming and gelling, as is shown in the table below in the "Total" column. In Table II below the various formulations employed are given, together with the beaker test gelling scores thereof.

TABLE II

| Anti-Gellant | Percent Anti-Gellant | Gelling Score (after noted hours) 1/4 | 1/2 | 1 | 2 | 3 | 4 | 5 | 6 | 24 | Total |
|---|---|---|---|---|---|---|---|---|---|---|---|
| None | 0 | 4 | 5 | 5 | 8 | 8 | 9 | 9 | 9 | 9 | 66 |
| NaCl | 3 | 1 | 1 | 3 | 4 | 4 | 4 | 4 | 5 | 4 | 30 |
| NaCl | 4 | 0 | 0 | 0 | 0 | 0 | 0 | 0 | 0 | 1 | 1 |
| LiCl | 2 | 2 | 2 | 4 | 5 | 5 | 5 | 5 | 5 | 8 | 41 |
| LiCl | 4 | 0 | 0 | 0 | 0 | 0 | 0 | 0 | 0 | 0 | 0 |
| Sodium Formate | 3 | 0 | 2 | 3 | 4 | 4 | 4 | 5 | 5 | 4 | 31 |
| Sodium | 4 | 0 | 0 | 0 | 0 | 0 | 0 | 0 | 0 | 1 | 1 |
| $NaNO_2$ | 4 | 3 | 3 | 3 | 4 | 5 | 5 | 5 | 8 | 9 | 45 |
| $NaNO_2$ | 5 | 2 | 3 | 3 | 3 | 4 | 4 | 4 | 4 | 4 | 31 |
| $Na_2SO_3$ | 3 | 5 | 5 | 5 | 5 | 8 | 8 | 8 | 8 | 9 | 61 |
| $Na_2SO_3$ | 4 | 1 | 3 | 4 | 4 | 5 | 5 | 5 | 5 | 5 | 37 |
| Sodium Isethionate | 5 | 2 | 3 | 4 | 4 | 4 | 5 | 5 | 5 | 8 | 40 |

From the above experiments it appears that all the listed salts are more effective than a previous anti-gellant used in liquid detergents, sodium isethionate, and certainly the treated liquid detergents gel to a much lesser extent than the control detergent in which no anti-gellant is employed. The products made are of satisfactory stability on storage and are of excellent detersive and foaming characteristics for dishwashing uses.

In addition to the results reported above it has been noted that among the sodium ion-containing salts that have an anti-gelling effect, sodium sulfate, especially at high concentrations, e.g., 5%, reduces gelling and filming tendencies of the detergent, too. However, this material sometimes forms glass-like crystals in the detergent which can block dispensing openings and which make the product objectionable to the average consumer. Sodium nitrate and other halides than sodium chloride, such as sodium bromide, potassium chloride and ammonium halides, especially other alkali metal chlorides, also exhibit anti-gelling properties when added to the described detergent compositions. Similar results are obtained when variations of the detergent formula are made, as in Example 1. Such results are also achieved when the ethanol is omitted from the formula or when other auxiliary solvents, such as isopropanol, are present, too.

In practice, a detergent composition of the above formula is made without any anti-gellant and then anti-gellant is added to it to break up the gel or film shown on the top of the beaker of detergent after it has stood long enough to develop such gel or film. The proportion of anti-gellant utilized, e.g., 4% NaCl, to effect the desired change is noted and that percentage of anti-gellant is added to the already made larger proportion of the batch and is incorporated in future batches of the same formula, using the same commercial starting materials. In this way, gelling and filming properties in the final commercial product are avoided.

EXAMPLE 3

| | Percent A | B |
|---|---|---|
| * Sodium alpha-olefin sulfonate (contains 2% NaCl, A.I. basis) | 18 | 16.1 |
| ** Ammonium higher fatty alcohol ethoxylate sulfate | 15 | 13.8 |
| Lauric myristic monoethanolamide (L:M=3.0) | 2.4 | 1.5 |
| Lauric myristic diethanolamide (L:M=3.0) | 2 | 3 |
| Sodium chloride | 2.6 | 2.5 |
| Sodium nitrate | 2 | 2 |
| Water, deionized | q.s. 100.0 | q.s. 100.0 |

Liquid detergents of the above formulas are made and are tested for film-forming and gelling properties, as well as for detergency and foaming characteristics. They are found to be satisfactory in all such areas. In the manufacture of these detergents 2% of sodium chloride is intentionally added to the detergent composition as an anti-gellant and 2% of sodium nitrate is added. 0.6% And 0.5% of sodium chloride accompany the alpha-olefin sulfonates, respectively, in the manufacture thereof as a result of a bleaching operation effected on such materials during manufacture. The products made are essentially non-corrosive to stainless steel and they are less corrosive to ordinary steels than are similar products without the nitrate component. When, in place of the nitrate, there are utilized other corrosion inhibitors, such as sodium chromate, potassium dichromate, corresponding alkali metal and ammonium or phosphates, alkali metal silicates, amine or sulfide inhibitors, or mixtures thereof, improved corrosion prevention results with respect to stainless steel and other ferrous alloys and materials coming into contact with the liquid detergent are obtained. When the corrosion inhibitors are omitted from the formula some corrosive effect is noted on the stainless steel, when subjected to microscopic examination.

When the percentages of sodium chloride are varied, increasing to as much as 8%, e.g., 6%, in the formulas, no gelling of the product is noted; however, at the higher percentages increasing proportions of sodium nitrate or other effective corrosion inhibitor are also utilized to counteract corrosive tendencies.

EXAMPLE 4

| | Percent |
|---|---|
| * Sodium alpha-olefin sulfonate | 7.9 |

-continued

| | Percent |
|---|---|
| *** Higher alcohol ethoxy ethanol (Alfonic 1012-6) | 4.0 |
| Lauric myristic diethanolamide (3:1 lauric:myristic) | 4.0 |
| Sodium chloride (added) | 0.8 |
| Perfume | 0.1 |
| Coloring | 0.01 |
| Deionized water | q.s. |

***57 ±2% ethylene oxide by weight; higher fatty alcohol being 2% max. $C_8$, 85 ±4% $C_{10}$, 8.5 ±2% $C_{12}$, 6.5 ±2% $C_{14}$ and 0.5% max. $C_{16}$, with a maximum of 2% of free alcohol. Molecular weight = 384 ±4 and Saponification No. = 140 – 155.

The above formulation is made by mixing the various constituents thereof in the water, adding the color and perfume last. The product made is tested in the manners previously described in Examples 1–3, by both the beaker and race track methods and in practical use tests. At the alpha-olefin sulfonate concentration, with the amount of sodium chloride present (about 1%, taking into account that added with the alpha-olefin sulfonate, which is about 2 to 3% thereof, on an active ingredient basis), the liquid detergent is neither gelling nor filming. Additionally, despite the absence of anti-corrosion ingredient present no corrosion of stainless steel by the liquid is noted. In fact, the lack of a tendency for the dishwashing detergent liquid to corrode stainless steel is about equal to this property of the detergents of EXAMPLES 1–3 wherein corrosion inhibitors are utilized.

When the formulation is changed to vary the proportion of alpha-olefin sulfonate to 6 and 10%, with the proportion of nonionic being changed to 3 to 6%, with that of LMDEA being changed to 3 and 5% and with the total sodium chloride being modified to be 0.5 and 1.5%, acceptable liquid detergents of satisfactory washing power (although not as effective in this respect as those of Examples 1–3) which are non-gelling and non-corrosive, result. It is also the case when the alpha-olefin sulfonates are modified to other chain distributions in the $C_{10}$ - $C_{16}$ range and when the higher fatty alcohol content of the alcohol ethoxy ethanol is altered to be $C_8$ - $C_{14}$, essentially, mixed with ethoxylates of other such alcohols, when the percentage of ethylene oxide is maintained in the 55 to 65% range. Useful products also result when the lauric myristic diethanolamide is partially replaced, up to 50% thereof, by lauric myristic monoethanolamide or other higher fatty acid lower alkanolamide wherein the higher fatty acid is of 12 to 16 carbon atoms and the lower alkanol is of 2 to 3 carbon atoms, preferably of two carbon atoms.

In the above formulas the best compositions are those in which the alpha-olefin sulfonate and the anti-gelling additive, such as the mentioned halide, are present as sodium salts. Instead of sodium chloride there may be utilized the sodium salts of nitrous acid, nitric acid, formic acid, acetic acid, sulfuric acid (although the product is undesirable when glassy deposits are formed) and sulfurous acid. The sodium-ion releasing material is preferably present in such concentration that from 0.5 to 3%, preferably from 0.8 to 2% of sodium ion is present in the liquid detergent apart from that in the detergent salt itself, with an additional 0.5 to 2% normally being present with the detergent. In such ranges the liquid detergents are satisfactorily non-gelling and are of desired controllable viscosity, apparently due to the presence of the sodium ion and of the anions of the anti-gellants which may be present. Such desirable viscosity control, usually accompanied by slight thickening effects, is noted in the various detergents described in this and the preceding examples. In place of sodium ion, lithium ion may often be substituted with comparable results being obtained, best results being exhibited by lithium chloride, as was previously indicated.

The formulation of Example 4 contains a relatively low concentration of olefin sulfonate and even when the sodium chloride is omitted, its gelling tendency is low (the gel score is 0 after one day). At this relatively low concentration the viscosity of the formulation, in the absence of sodium chloride, is lower than is preferred for such light duty detergent liquids for household use. The addition of the 0.8% NaCL results in an increase in viscosity, from about 20 centipoises to about 200 centipoises (Brookfield viscosity). Preferred light duty liquid detergents of the invention have viscosities in the range of about 100 to 600 cps., preferably about 120 to 300 cps.

It should be clear that the addition of anti-gellant and other materials employed will not be past the point of solubility in the detergent liquid. Thus, those materials used, especially as anti-gellants, will be soluble in the detergent after storage as long as 2 weeks at 5° C.

The invention has been described with respect to illustrative examples and descriptions thereof but is not to be limited to these because it is evident that one of skill in the art will be able to utilize equivalents and substitutes without departing from the spirit of the invention or going beyond its scope.

What is claimed is:

1. A liquid detergent consisting essentially of a detersive proportion of about 12 to 22% of water soluble olefin sulfonate salt of a carbon content in the range of 10 to 20, 10–20% of water soluble alcohol ethoxylate sulfate in which the alcohol is of a carbon atom content in the range of 10 to 20 and which contains about 1 to 20 ethoxy groups, a foam stabilizing proportion of at least one foam stabilizer, an anti-gelling proportion, in combination, of at least one halide and at least one nitrate, with the proportion of halide being from 2 to 8% and the proportion of nitrate being from 1 to 15% and with the proportion of nitrate salt being sufficient to inhibit corrosion of ferrous metals and ferrous metal alloys which are brought into contact with the liquid detergent, and an aqueous medium.

2. A liquid detergent according to claim 1 wherein the olefin of the water soluble olefin sulfonate salt is an alphaolefin, the number of ethoxy groups per molecule in the alcohol ethoxylate sulfate is from 1 to 10, the weight ratio of olefin sulfonate to alcohol ethoxylate sulfate is from 0.4:1 to 3:1, the foam stabilizer is a fatty acid alkanolamide wherein the fatty acid is of a carbon atom content in the range of 10 to 16 and 2 to 7% of such fatty acid alkanolamide is present, and the proportion of aqueous medium is from 24 to 73%.

3. A liquid dishwashing detergent according to claim 2 comprising about 15 to 20% of alkali metal alpha-olefin sulfonate salt in which the olefin is of 10 to 16 carbon atoms, 12 to 18% of water soluble alkanol ethoxylate sulfate in which the alkanol is of 10 to 18 carbon atoms, with the ratio of alpha-olefin sulfonate to alcohol ethoxylate sulfate being from 0.5:1 to 2:1, 3 to 6% of a mixture of mono- and dialkanolamides in which the ratio of monoalkanolamide:dialkanolamide is from 0.2 to 3, 2 to 6% of alkali metal halide, 1 to 5% of alkali metal nitrate and 45 to 67% water.

4. A liquid dishwashing detergent according to claim 3 wherein the alpha-olefin sulfonate is sodium alpha-olefin sulfonate, the alcohol ethoxylate sulfate is ammonium alcohol ethoxylate sulfate of 1 to 5 ethoxy groups per molecule, in which the alcohol is of 12 to 15 carbon atoms, the alkali metal halide is sodium chloride and the alkali metal nitrate is sodium nitrate.

5. A liquid dishwashing detergent according to claim 4 with about 15 to 20% of sodium alpha-olefin sulfonate in which the olefin is of 14 to 16 carbon atoms, 12 to 18% ammonium alcohol ethoxylate sulfate of 1 to 5 ethoxy groups per molecule, 3 to 6%, in combination, of lauric myristic monoethanolamide and lauric myristic diethanolamide in which the proportions of lauric:myristic in the monoalkanolamide and dialkanolamide are from 0.3:1 to 10:1 and the proportion of monoalkanolamide to dialkanolamide is from 0.3 to 1.5, 2 to 4% of sodium chloride, 1 to 4% of sodium nitrate and 48 to 67% of water.

6. A liquid dishwashing detergent according to claim 5 which contains about 18% of the sodium alpha-olefin sulfonate, about 15% of the ammonium alcohol ethoxylate sulfate, about 2.4% of lauric myristic monoethanolamide wherein the ratio of lauric: myristic in the monoethanolamide is about 3:1, about 2% of lauric myristic diethanolamide wherein the ratio of lauric: myristic in the diethanolamide is about 3:1, about 2.6% of sodium chloride, about 2% of sodium nitrate and about 58% of water.

7. A liquid dishwashing detergent according to claim 5 which contains about 16.1% of the sodium alpha-olefin sulfonate, about 13.8% of the ammonium alcohol ethoxylate sulfate, about 1.5% of lauric myristic monoethanolamide wherein the ratio of lauric:myristic in the monoethanolamide is about 3:1, about 3.5% of lauric myristic diethanolamide wherein the ratio of lauric:myristic in the diethanolamide is about 3:1, about 1.8% of sodium xylene sulfonate, about 0.5% of $MgSO_4$, about 0.1% of trisodium hydroxyethyl ethylene diamine triacetate, about 2.5% of sodium chloride, about 2% of sodium nitrate and about 58% of water.

8. A liquid detergent consisting essentially of a normally gelling or film forming proportion of at least one water soluble olefin sulfonate detergent salt and an anti-gelling and anti-filming proportion within the range of 2 to 12% of at least one salt selected from the group consisting of halides, nitrates, sulfides, nitrites and salts of aliphatic acids of 1 to 3 carbon atoms, and mixtures thereof.

9. A liquid detergent according to claim 8 wherein the water soluble olefin sulfonate salt is an alpha-olefin sulfonate of 10 to 20 carbon atoms per molecule and the anti-gelling and anti-filming agent is a halide.

10. A liquid detergent according to claim 9, suitable for dishwashing, comprising about 12 to 22% of water soluble alpha-olefin sulfonate salt in which the alpha-olefin is of 10 to 16 carbon atoms and in which the halide salt is an alkali metal chloride.

11. A liquid dishwashing detergent according to claim 10 comprising about 15 to 20% of alkali metal alpha-olefin sulfonate salt, 12 to 18% of alkanol ethoxylate sulfate in which the alkanol is of 10 to 18 carbon atoms and the number of ethoxy groups per molecule is from 1 to 10, with the ratio of alpha-olefin sulfonate to alcohol ethoxylate sulfate being from 0.4:1 to 3:1, 2 to 7% of fatty acid alkanolamide wherein the fatty acid is of a carbon atom content in the range of 10 to 16 per molecule, 2 to 6% of alkali metal chloride and from 49 to 69% of an aqueous medium.

12. A liquid dishwashing detergent according to claim 11 in which the ratio of alpha-olefin sulfonate to alcohol ethoxylate sulfate is from 0.5:1 to 2:1, the content of alkanolamide is 3 to 6% of a mixture of mono- and dialkanolamide in which the ratio of monoalkanolamide:dialkanolamide is from 0.2 to 3, and which contains 50 to 68% of water.

13. A liquid dishwashing detergent according to claim 12 wherein the alpha-olefin sulfonate is sodium alpha-olefin sulfonate, the alcohol ethoxylate sulfate is ammonium alcohol ethoxylate sulfate of 1 to 5 ethoxy groups per molecule, in which the alcohol is of 12 to 15 carbon atoms, and the alkali metal halide is sodium chloride.

14. A liquid dishwashing detergent according to claim 13 which comprises about 15 to 20% of sodium alpha-olefin sulfonate in which the olefin is of 14 to 16 carbon atoms, 12 to 18% ammonium alcohol ethoxylate sulfate of 1 to 5 ethoxy groups per molecule, 3 to 6%, in combination, of lauric myristic monoethanolamide and lauric myristic diethanolamide in which the proportions of lauric:myristic in the monoalkanolamide and dialkanolamide are from 0.3:1 to 10:1 and the proportion of monoalkanolamide to dialkanolamide is from 0.3 to 1.5, 2 to 6% of sodium chloride and 50 to 68% of water.

15. A liquid dishwashing detergent according to claim 14 which contains an anti-corrosive proportion of an anti-corrosion agent to prevent corrosion of stainless steel in contact with the dishwashing detergent.

16. A liquid detergent, suitable for dishwashing, comprising 5 to 11% of a water soluble alpha-olefin sulfonate salt of 10 to 20 carbon atoms per molecule and an anti-gelling and anti-filming proportion, from 0.2 to 1.5% of a halide.

17. A liquid dishwashing detergent according to claim 16, comprising about 6 to 10% of water soluble alpha-olefin sulfonate salt in which the alpha-olefin is of 10 to 16 carbon atoms and in which the halide salt is an alkali metal chloride, which is from 0.5 to 1% of the detergent.

18. A liquid dishwashing detergent according to claim 17 which includes a higher alcohol ethoxylate of about 55 to 60% ethylene oxide content.

19. A liquid dishwashing detergent according to claim 18 in which the higher fatty alcohol ethoxylate is of an essentially $C_{10}$ higher fatty alcohol and is 2 to 8% of the liquid detergent.

20. A liquid dishwashing detergent according to claim 19 which includes from 3 to 7% of a higher fatty acid - lower alkanolamide.

21. A liquid dishwashing detergent according to claim 19 wherein the alkanolamide is substantially all dialkanolamide.

22. A liquid dishwashing detergent according to claim 21 wherein the alkanolamide is lauric myristic diethanolamide and the ratio of lauric:myristic is from 0.3 to 10:1.

23. A liquid dishwashing detergent according to claim 22, which comprises about 8% of sodium alpha-olefin sulfonate in which the olefin is of 14 to 16 carbon atoms, 4% of a higher fatty alcohol ethoxylated nonionic detergent, 4% of lauric myristic diethanolamide wherein the lauric:myristic ratio is about 3:1 and about 1% of sodium chloride, in an aqueous medium.

24. A liquid dishwashing detergent according to claim 23 wherein the aqueous medium is water.

25. A method of inhibiting gelling and film forming, on standing, of a liquid detergent composition comprising a detersive proportion of at least one water soluble olefin sulfonate salt of a carbon atom content in the range of 10 to 20 and simultaneously making said composition non-corrosive to ferrous metals and ferrous metal alloys which may be brought into contact therewith which comprises admixing with the components of such liquid detergent composition an anti-gelling, anti-filming and corrosion inhibiting proportion, in combination, of at least one halide salt, the proportion of such salt being from 0.2 to 8% of the composition produced, and at least one nitrate salt, the proportion of such salt being from 1 to 15% of the composition.

26. A method according to claim 25 wherein the liquid detergent comprises at least one water soluble alcohol ethoxylate sulfate in which the alcohol is of a carbon atom content in the range of 10 to 20 and contains from about 1 to 20 ethoxy groups, and a foam stabilizing proportion of at least one foam stabilizer, a gel or film is produced on the surface of the liquid detergent and at least one alkali metal halide and at least one alkali metal nitrate are admixed with the detergent to liquefy such gel or film.

27. A method according to claim 26 wherein the liquid detergent is a liquid dishwashing detergent which comprises, after the addition of the halide and nitrate, about 15 to 20% of sodium alpha-olefin sulfonate in which the olefin is of 14 to 16 carbon atoms, 12 to 18% of ammonium alcohol ethoxylate sulfate of 1 to 5 ethoxy groups per molecule, in which the alcohol is of 12 to 15 carbon atoms, 3 to 6%, in combination, of lauric myristic monoethanolamide and lauric myristic diethanolamide, in which the proportions of lauric:myristic in the monoalkanolamide and dialkanolamide are from 0.3:1 to 10:1 and the proportion of monoalkanolamide to dialkanolamide is from 0.3 to 1.5, 2 to 4% of sodium chloride, 1 to 4% of sodium nitrate and 48 to 67% of water.

28. A method of inhbiting gelling and film forming, on standing, of a liquid detergent composition comprising a detersive proportion of at least one water soluble olefin sulfonate salt of a carbon atom content in the range of 10 to 20, which comprises admixing with components of such liquid detergent an anti-gelling and anti-filming proportion, at least 0.2%, of at least one salt selected from the group consisting of halides, nitrates, sulfites, nitrites and those of aliphatic acids of 1 to 3 carbon atoms, and mixtures thereof.

29. A method according to claim 28 wherein the liquid detergent comprises at least one water soluble alcohol ethoxylate sulfate in which the alcohol is of a carbon atom content in the range of 10 to 20 and contains from about 1 to 20 ethoxy groups, and a foam stabilizing proportion of at least one foam stabilizer, a gel or film is produced on the surface of the liquid detergent and at least one alkali metal halide is admixed with the detergent to liquefy such gel or film.

30. A method according to claim 29 wherein the liquid detergent is a liquid dishwashing detergent which comprises, after the addition of the halide, about 15 to 20% of sodium alpha-olefin sulfonate in which the olefin is of 14 to 16 carbon atoms, 12 to 18% of ammonium alcohol ethoxylate sulfate of 1 to 5 ethoxy groups per molecule, in which the alcohol is of 12 to 15 carbon atoms, 3 to 6%, in combination, of lauric myristic monoethanolamide and lauric myristic diethanolamide in which the proportions of lauric:myristic in the monoalkanolamide and dialkanolamide are from 0.3:1 to 10:1 and the proportion of monoalkanolamide to dialkanolamide is from 0.3 to 1.5, 2 to 4% of sodium chloride, 1 to 4% of sodium nitrate and 48 to 67% of water.

* * * * *